US007580648B2

(12) United States Patent
Shaw et al.

(10) Patent No.: US 7,580,648 B2
(45) Date of Patent: Aug. 25, 2009

(54) SYSTEMS AND METHODS FOR MOMENTUM CONTROLLED SCAVENGELESS JUMPING DEVELOPMENT IN ELECTROPHOTOGRAPHIC MARKING DEVICES

(75) Inventors: John Gary Shaw, Victor, NY (US); Paul W. Morehouse, Jr., Webster, NY (US)

(73) Assignee: Xerox Corporation, Norwalk, CT (US)

( * ) Notice: Subject to any disclaimer, the term of this patent is extended or adjusted under 35 U.S.C. 154(b) by 301 days.

(21) Appl. No.: 11/691,834

(22) Filed: Mar. 27, 2007

(65) Prior Publication Data

US 2008/0240758 A1 Oct. 2, 2008

(51) Int. Cl.
*G03G 15/06* (2006.01)
*G03G 15/08* (2006.01)

(52) U.S. Cl. ..... 399/55; 399/266

(58) Field of Classification Search ..... 399/55, 399/266, 285, 290

See application file for complete search history.

(56) References Cited

U.S. PATENT DOCUMENTS

| | | | | |
|---|---|---|---|---|
| 5,453,768 | A * | 9/1995 | Schmidlin | 399/285 X |
| 5,678,130 | A * | 10/1997 | Enomoto et al. | 399/55 |
| 6,026,264 | A | 2/2000 | Wong et al. | |
| 6,035,170 | A * | 3/2000 | Snelling | 399/266 |
| 6,223,013 | B1 | 4/2001 | Eklund et al. | |
| 6,360,067 | B1 * | 3/2002 | Hays et al. | 399/266 X |
| 6,459,862 | B1 * | 10/2002 | Sakemi et al. | 399/55 |
| 7,079,794 | B2 | 7/2006 | Forbes, II et al. | |

* cited by examiner

*Primary Examiner*—Sandra L Brase
(74) *Attorney, Agent, or Firm*—Oliff & Berridge, PLC

(57) ABSTRACT

To generate a toner cloud in a development system, a first potential is applied to a donor roll for a first pulse time to project toner from the donor roll toward a photoreceptor; a second potential is applied to the donor roll for a second pulse time to slow the speed at which the toner is projected toward the photoreceptor; a third potential is applied to the donor roll for a third pulse time to hold toner between the donor roll and the photoreceptor; and a fourth potential is applied to the donor roll for a fourth pulse time to urge undeveloped toner to the surface of the donor roll. Voltages may also be applied for selectivity removing toner from a donor roll.

18 Claims, 7 Drawing Sheets

SYSTEMS AND METHODS FOR MOMENTUM CONTROLLED SCAVENGELESS JUMPING DEVELOPMENT IN ELECTROPHOTOGRAPHIC MARKING DEVICES

BACKGROUND

This disclosure relates to maintaining print quality in electrophotographic marking devices. For example, teachings herein are directed to systems and methods for developing a photoreceptor in a developing system of a marking device.

Generally, the electrophotographic printing includes charging a photoconductive member such as a photoconductive belt or drum to a substantially uniform potential to sensitize the photoconductive surface thereof. The charged portion of the photoconductive surface is exposed to a light image from a scanning laser beam, a light emitting diode (LED) source, or other light source. This records an electrostatic latent image on the photoconductive surface. After the electrostatic latent image is recorded on the photoconductive surface, the latent image is developed in a developer system with charged toner. The toner powder image is subsequently transferred to a copy sheet and heated to permanently fuse it to the copy sheet.

SUMMARY

The electrophotographic marking process given above can be used to produce color images. One type of electrographic marking process, called image-on-image (IOI) processing, superimposes toner powder images of different color toners onto a photoreceptor prior to the transfer on the composite toner powder image onto to a substrate such as paper. While the IOI process provides certain benefits, such as a compact architecture, there are several challenges to its successful implementation. For instance, in IOI processing, the developer system should not interact with previously toned images.

In the developer system, two-component or single-component developer materials are commonly used. A typical two-component developer material comprises magnetic carrier granules having toner particles adhering triboelectrically thereto. A single-component developer material typically comprises toner particles. Since several known developer systems such as conventional two-component magnetic brush development systems and single-component jumping development systems interact with the photoconductive surface, a previously toned image will be scavenged by subsequent developer stations if interacting developer systems are used. Thus, for the IOI process, there is a need for noninteractive developer systems, such as hybrid scavengeless development (HSD).

In scavengeless developer systems such as HSD systems, toner is conveyed onto the surface of the donor roll. Current embodiments of scavengeless developer systems transfer toner from the surface of the donor roll to a photoconductive surface in the following manner. The toner layer on the donor roll is disturbed by electric fields from a wire or set of wires to produce and sustain an agitated cloud of toner particles. The toner particles in the agitated cloud are attracted to the latent image to form a toner powder image on the photoconductive surface.

For image-on-image (IOI) electrophotographic imaging it is desirable to have scavengeless development subsystems that will not disturb existing images on the photoreceptor. Current embodiments of HSD systems used for non-interactive development in IOI color printers accomplish this by using wire-based development systems, in which a series of AC biased wires are closely spaced from a donor roll to detach toner and form a toner cloud in the development nip, the region between the donor roll and the photoreceptor.

There are shortfalls associated with this development method due to wire contamination, which can result in image quality defects. The wires become contaminated with particulate matter consisting of unmodified and modified toner (e.g., crushed and pressured-fused toner sometimes known as "corn flakes") and related flow and charge-control agents. A present solution to this problem is to frequently replace the wires, which increases maintenance costs and downtime of the product.

There is a need for new scavengeless developer systems and methods of operating developer systems that work as well as HSD, but without the need for wires.

In embodiments disclosed herein, a developer system, such as jumping development systems, reduces or eliminates the "scavenging effect." Scavenging is due to the aggressive bombardment of an existing developed (partial) image on a photoreceptor by undeveloped toner, generally from the "toner cloud" in the development nip. Existing developed images on the photoreceptor can be damaged and/or destroyed by the scavenging process.

In embodiments, the potential applied across the development nip of a development system is modulated to allow development to occur on the photoreceptor, driven by the latent charge image, without undue scavenging action.

In embodiments, latent charge image on a photoreceptor is developed by projecting toner from a surface of a donor roll toward the photoreceptor, slowing the speed at which the toner is projected toward the photoreceptor, and urging undeveloped toner to the surface of the donor roll.

In embodiments, the toner is held between the donor roll and the photoreceptor, prior to the urging step, to allow development of the latent image.

While specific embodiments are described, it will be understood that they are not intended to be limiting. For example, even though the example given is a color process employing Image-On-Image technology, the disclosure is applicable to any system having donor rolls that use voltages to develop toner to the photoreceptor.

EMBODIMENTS

Figure 1:
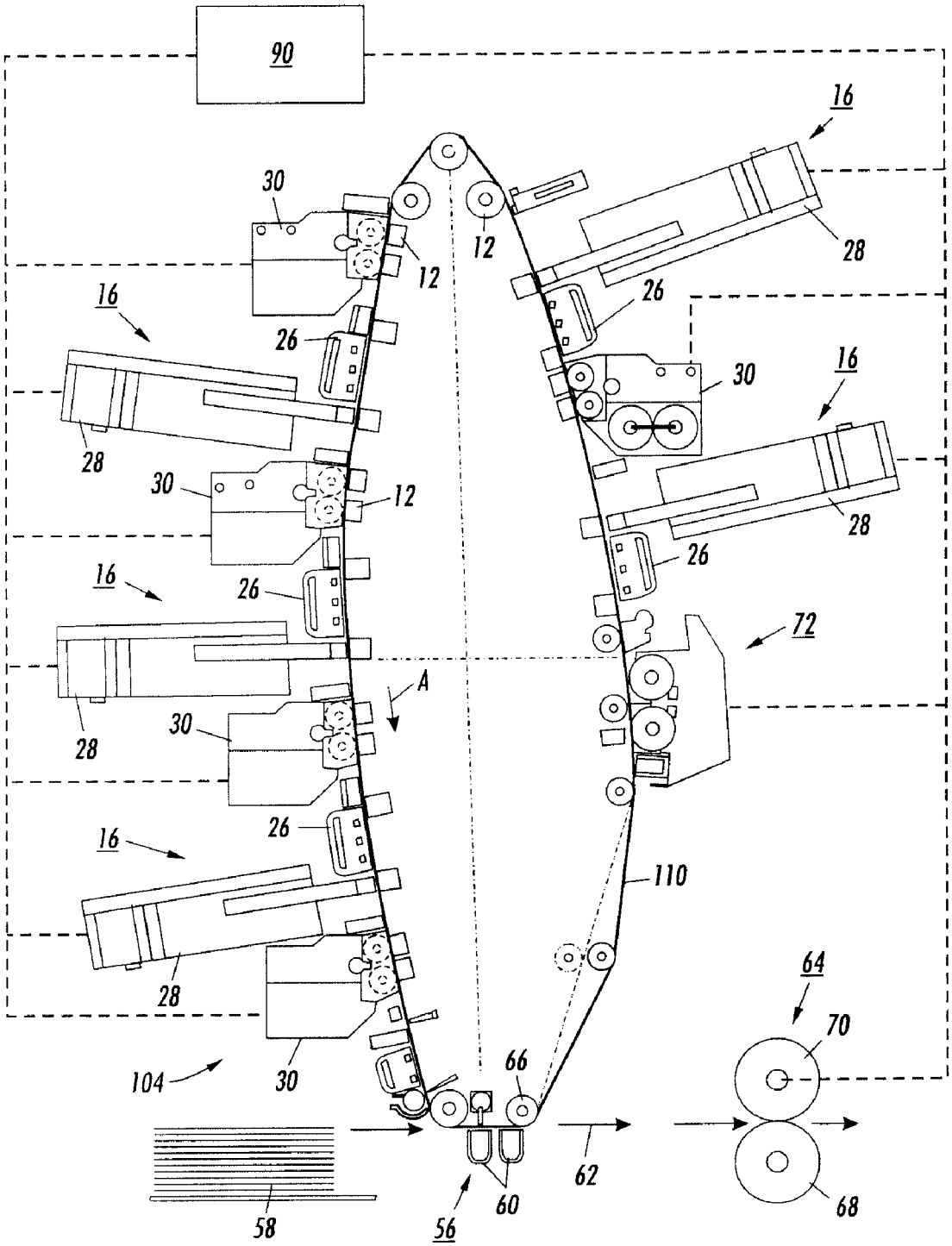
FIG. 1 is a schematic representation of an exemplary embodiment of an IOI marking device having an exemplary embodiment of a scavengeless developer system.

In the following description, reference is made to the drawings. In the drawings, like reference numerals have been used throughout to designate identical elements.

Referring now to the drawings, there is shown in FIG. 1 an exemplary embodiment of an Image-on-Image (IOI) marking device 104, which is a single pass multi-color marking device. The marking device 104 includes a photoconductive belt 110, supported by a plurality of rollers or bars 12. The photoconductive belt 110 is depicted in a generally vertical orientation, but it will be appreciated that a generally horizontal or diagonal orientation is also acceptable, or that the photoconductive belt 110 may be replaced by a photoconductive drum. The photoconductive belt 110 advances in the direction of arrow A to move successive portions of the external surface of the photo conductive belt 110 sequentially beneath the various processing stations disposed about the path of movement thereof. The marking device 104 includes image recording stations 16, which include a charging device and an exposure device. The charging devices include a corona generator 26 that charges the exterior surface of the photoconductive belt 110 to a relatively high, substantially uniform potential. After the exterior surface of the photoconductive belt 110 is charged, the charged portion thereof advances to the exposure device. The exposure devices include a raster output scanner (ROS) 28, which illuminates the charged portion of the exterior surface of the photoconductive belt 110 to record a first electrostatic latent image thereon.

The electrostatic latent images are developed by developer units 30, which deposit toner particles of a selected color on the electrostatic latent images. After the toner image of a selected color has been developed on the exterior surface of the photoconductive belt 110, the photoconductive belt 110 continues to advance in the direction of arrow A to the next image recording station 16. In this way, a multi-color toner powder image is formed on the exterior surface of the photoconductive belt 110. Thereafter, the photoconductive belt 110 advances the multi-color toner powder image to a transfer station, indicated generally by the reference numeral 56.

At transfer station 56, a receiving medium, e.g., paper, is advanced from stack 58 by a sheet feeder and guided to transfer station 56. At transfer station 56, a corona generating device 60 sprays ions onto the backside of the paper. This attracts the developed multi-color toner image from the exterior surface of the photoconductive belt 110 to the sheet of paper. Stripping assist roller 66 contacts the interior surface of the photoconductive belt 110 and provides a bend whereat the sheet disengages from contact with the photoconductive belt 110. A vacuum transport then moves the sheet of paper in the direction of arrow 62 to fusing station 64, which includes a heated fuser roller 70 and a back-up roller 68 that form a nip through which the sheet of paper passes. In the fusing operation, the toner particles bond to the sheet in image configuration, forming a multi-color image thereon. After fusing, the finished sheet is discharged.

After the multi-color toner powder image has been transferred to the sheet of paper, residual toner particles typically remain adhering to the exterior surface of the photoconductive belt 110. The photoconductive belt 110 moves to a cleaning station 72, where residual toner particles are removed from the photoconductive belt 110. One skilled in the art will appreciate that while the multi-color developed image has been disclosed as being transferred to paper, it may be transferred to an intermediate member, such as a belt or drum, and then subsequently transferred and fused to the paper.

Figure 2:
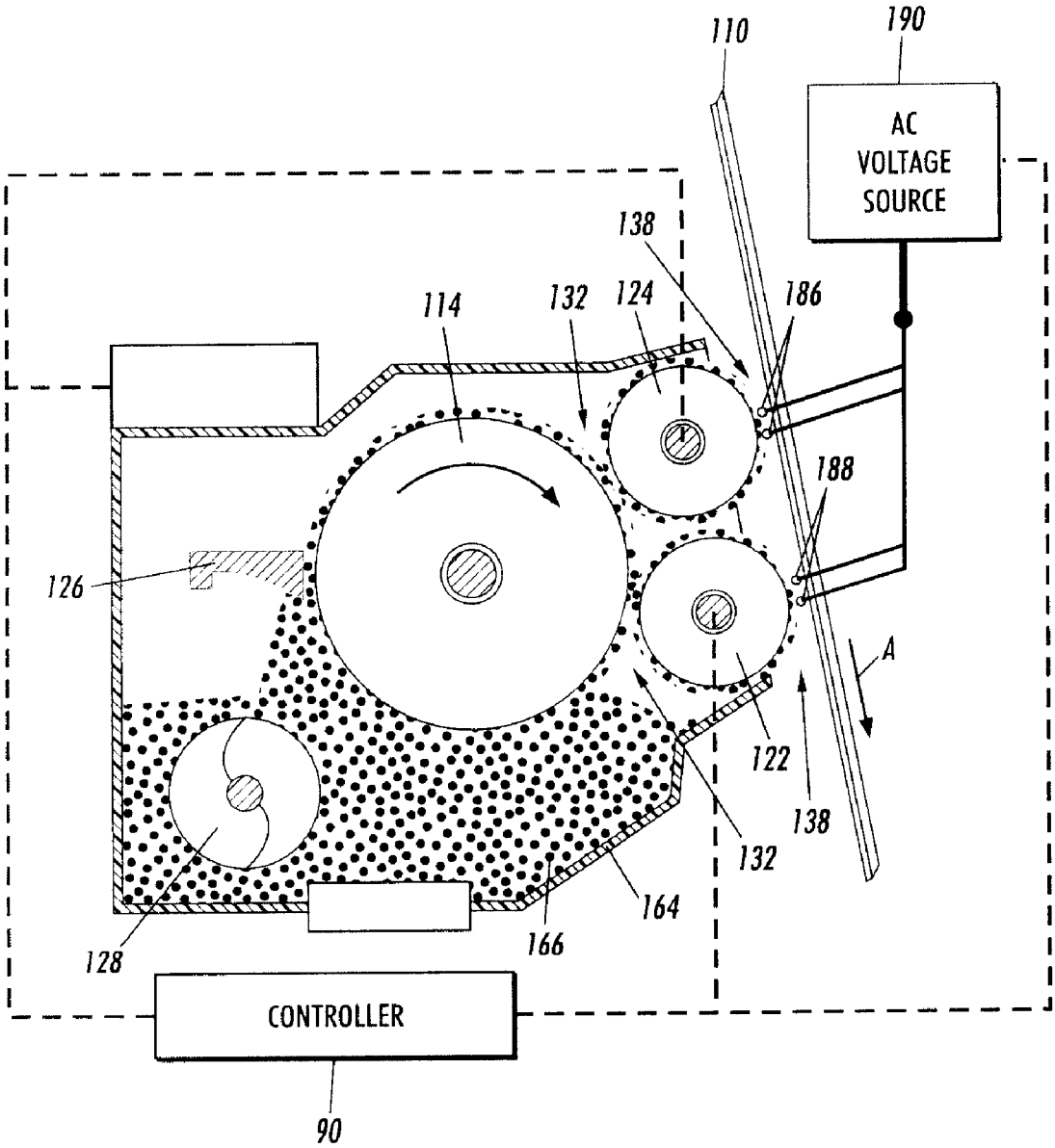
FIG. 2 PRIOR ART
FIG. 2 is a side sectional view of a conventional embodiment of a scavengeless developer system.

Referring now to FIG. 2, there are shown details of a scavengeless developer apparatus known in the art. One such apparatus is described in U.S. Pat. No. 7,079,794, which is herein incorporated by reference in its entirety. The apparatus comprises a developer housing having a reservoir 164 containing developer material 166. The developer material is of the two-component type, meaning that it comprises conductive carrier granules and toner particles. The reservoir 164 includes one or more augers 128, which are rotatably mounted in the reservoir chamber. The augers 128 serve to transport and to agitate the developer material within the reservoir 164 and encourage the toner to charge and adhere triboelectrically to the carrier granules.

The developer apparatus has a single magnetic brush roll, referred to as a mag roll 114, that transports developer material from the reservoir 164 to loading nips 132 formed between the mag roll 114 and a pair of donor rolls 122 and 124.

The mag roll 114 may comprise a rotatable tubular housing within which is located a stationary magnetic cylinder having a plurality of magnetic poles arranged around its surface. Mag rolls are well known, so further details of the construction of the mag roll 114 need not be described here. The carrier granules of the developer material are magnetic, and as the tubular housing of the mag roll 114 rotates, the granules (with toner particles adhering triboelectrically thereto) are attracted to the mag roll 114 and are conveyed to the donor roll loading nips 132. A trim blade 126, also referred to as a metering blade or a trim, removes excess developer material from the mag roll 114 and ensures an even depth of coverage with developer material before arrival at the first donor roll loading nip 132 proximate the upper donor roll 124. At each of the donor roll loading nips 132, toner particles are transferred from the mag roll 114 to the respective donor rolls 122 and 124.

Each donor roll 122 and 124 transports the toner to a respective developer zone, also referred to as a developer nip 138, through which the photoconductive belt 110 passes. Transfer of toner from the mag roll 124 to the donor rolls 122 and 124 can be encouraged by, for example, the application of a suitable electrical bias to the mag roll 114 and/or donor rolls 122 and 124. The bias establishes an electrostatic field between the mag roll 114 and donor rolls 122 and 124, which causes toner to be attracted to the donor rolls 122 and 124 from the carrier granules on the mag roll 114.

The carrier granules and any toner particles that remain on the mag roll 114 are returned to the reservoir 164 as the mag roll 114 continues to rotate. The relative amounts of toner transferred from the mag roll 114 to the donor rolls 122 and 124 can be adjusted, for example by: applying different bias voltages, including AC voltages, to the donor rolls 122 and 124; adjusting the mag-roll-to-donor-roll spacing; adjusting the strength and shape of the magnetic field at the loading nips 132; and/or adjusting the rotational speeds of the mag roll 114 and/or donor rolls 122 and 124.

At each of the developer nips 138, toner is transferred from the respective donor rolls 122 and 124 to the latent image on the photoconductive belt 110 to form a toner powder image on the photoconductive belt 110.

In FIG. 2, at the developer nips 138, electrode wires 186 and 188 are disposed in the space between each donor roll 122 and 124 and the photoconductive belt 110. For each donor roll 122 and 124, one or more electrode wires 186 and 188 extends in a direction substantially parallel to the longitudinal axis of the donor rolls 122 and 124. The electrode wires 186 and 188 are closely spaced from the respective donor rolls 122 and 124. The ends of the electrode wires 186 and 188 are preferably attached so that they are slightly above a tangent to the surface, including the toner layer, of the donor rolls 122 and 124. An alternating electrical bias is applied to the electrode wires 186 and 188 by an AC voltage source. When a voltage difference exists between the wires 186 and 188 and donor rolls 122 and 124, the electrostatic attraction attracts the wires to the surface of the toner layer.

The applied AC voltage to the wires 186 and 188 establishes an alternating electrostatic field between the electrode wires 186 and 188 and the respective donor rolls 122 and 124, which is effective in detaching toner from the surface of the donor rolls 122 and 124 and forming a toner cloud about the electrode wires 186 and 188, the height of the cloud being such as not to be substantially in contact with the photoconductive belt 110. A DC bias supply applied to each donor roll 122 and 124 establishes electrostatic fields between the photoconductive belt 110 and donor rolls 122 and 124 for attracting the detached toner from the toner clouds surrounding the electrode wires 186 and 188 to the latent image recorded on the photoconductive surface of the photoconductive belt 110.

In embodiments, according to this disclosure, methods are provided for operating scavengeless developer systems without the need for wires, such as the wires 186 and 188 shown in FIG. 2, utilizing a process that shall hereafter be called Momentum Controlled Scavengeless Jumping Development (MC-SJD).

Figure 3:
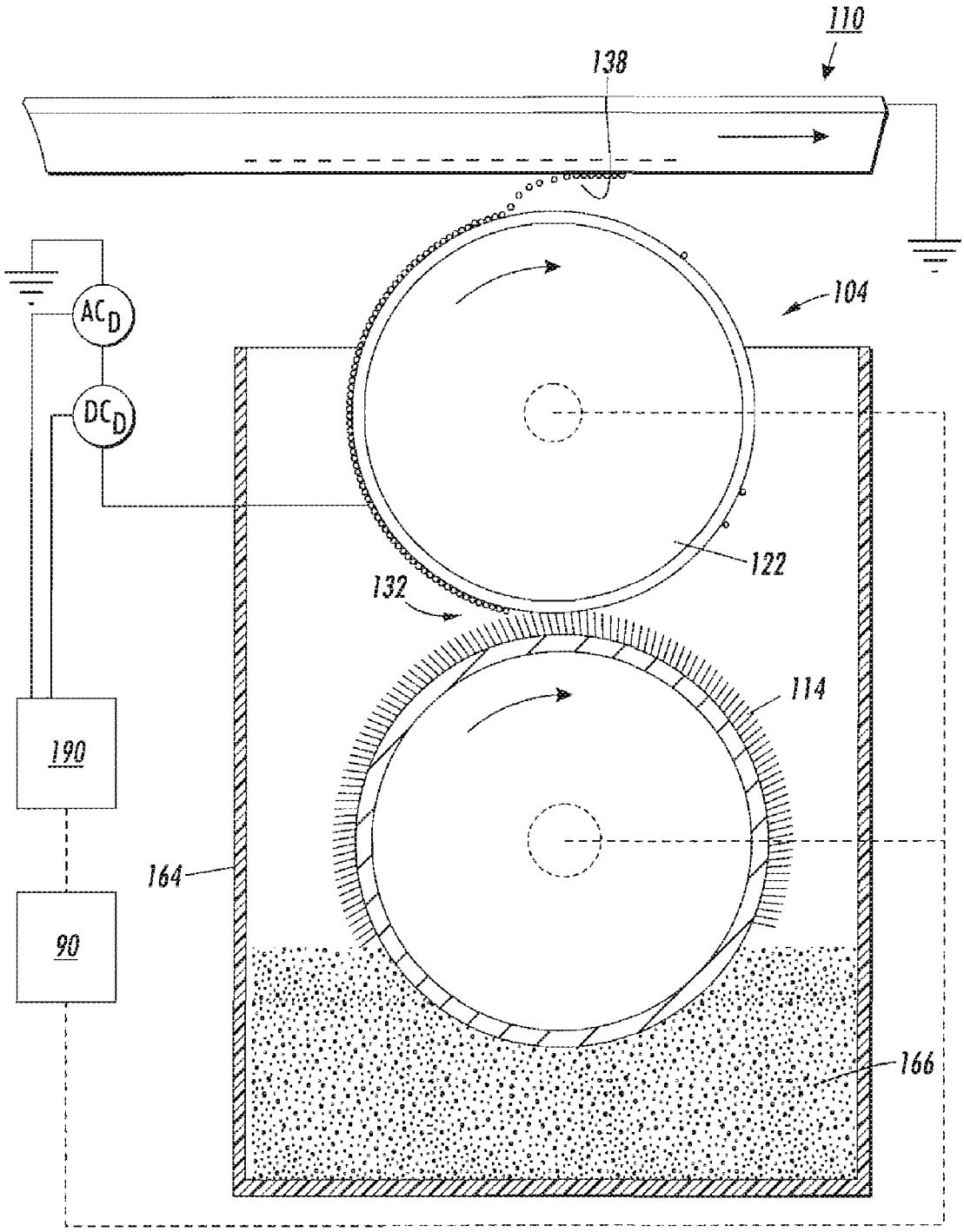
FIG. 3 is a side sectional view of an embodiment of an exemplary embodiment of a developer system.

FIG. 3 provides a marking device 104 that incorporates an apparatus for developing a photoreceptor 110 having a latent charge image utilizing the MC-SJD process. It is noted that the structure shown in FIG. 3 is similar to a structure described in, e.g., U.S. Pat. No. 6,223,013, the disclosure of which is incorporated herein by reference in its entirety. The apparatus comprises a conductive member in the form of a rotatable conductive donor roll 122 spaced from the photoreceptor 110, a voltage source 190 connected to the donor roll 122, and a controller 90. Toner is loaded onto a surface of the donor roll 122. The controller 90 applies a series of voltages to the donor roll 122 as shown, for example, in the timing diagram provided in FIG. 4. More specifically, the controller 90 controls the voltage source 190 to apply a first potential P1 to the donor roll 122 for a first pulse time T1 to project toner from the donor roil 122 toward the photoreceptor 122; to apply a second potential P2 to the donor roll 122 for a second pulse time T2 to slow the speed at which the toner is projected toward the photoreceptor 110; to apply a third potential P3 to the donor roll 122 for a third pulse time T3 to hold toner between the donor roll 122 and the photoreceptor 110, wherein the third potential P3 is smaller in magnitude than the first potential P1; and to apply a fourth potential P4 to the donor roll 122 for a fourth pulse time T4 to urge undeveloped toner to the surface of the donor roll 122.

In embodiments wherein the toner is negatively charged, the apparatus for developing a photoreceptor 122 utilizing the MC-SJD process is operated so that the first potential P1 and the third potential P3 are negative; and the second potential P2 and the fourth potential P4 are positive. In embodiments wherein the toner is positively charged, the apparatus for developing a photoreceptor 122 utilizing the MC-SJD process is operated so that the first potential P1 and the third potential P3 are positive; and the second potential P2 and the fourth potential P4 are negative. In some embodiments, each of the potentials P1, P2, P3, P4 are different and each of the pulse times T1, T2, T3, T4 are different. In some embodiments, the apparatus may be operated so that the total time period TT for the first pulse time T1, the second pulse time T2, the third pulse time T3, and the fourth pulse time T4 is in the range of from about 150 microseconds to about 600 microseconds, and preferably about 350 microseconds.

Assuming that the back of the photoreceptor 110 is grounded, and that negatively charged toner is used, the potentials P1, P2, P3, P4 applied to the donor roll 122 during each stage of the above method may be those sufficient to perform the recited steps. Likewise, the pulse times T1, T2, T3, T4 for these potentials may be those durations sufficient to perform the recited steps.

The four-stage MC-SJD waveform may have different potentials P1, P2, P3, P4 and different pulse times T1, T2, T3, T4 for different systems based on, for example, differences in the type of toner used, development gap spacing, and the level of DC bias in the development nip 138. The particular combination of voltages and pulse times typically should be selected empirically, based on testing a particular toner in a particular system.

As one example, it is assumed the back of the photoreceptor 110 is grounded. Further, a conventional negatively charged toner is used, such as for instance a conventional toner utilized in a conventional HSD marking device, which may include toner sized in the range of from about 3 μm to 10 μm having a negative triboelectrical charge in the range of about −10 μC/g to about −45 μC/g. Additionally, the development gap may be at a distance of approximately 300 μm with an image charge density of the photoreceptor 110 of −50 $\mu C/m^2$, a background charge density of the photoreceptor 110 of −350 $\mu C/m^2$. In this specific example, the potential P1 may be in the range of from about −2500 Volts to about −850 Volts, and preferably about −1200 Volts for a pulse time T1 that may be in the range of from about 5 microseconds to about 35 microseconds, and preferably about 20 microseconds. The potential P2 may be in the range of from about +500 Volts to about +1500 Volts, and preferably about +1000 Volts for a pulse time T2 that may be in the range of from about 25 microseconds to about 100 microseconds, and preferably about 60 microseconds. The potential P3 may be in the range of from about −300 Volts to about −100 Volts, and preferably about −200 Volts for a pulse time T3 that may be in the range of from about 35 microseconds to about 145 microseconds, and preferably about 85 microseconds. The potential P4 may be in the range of from about +100 Volts to about +300 Volts, and preferably about +200 Volts for a pulse time T4 that may be in the range of from about 80 microseconds to about 325 microseconds, and preferably about 190 microseconds, and with an additional potential applied to the donor roll that may be a DC bias of about −200 Volts. Of course, these values should be adjusted, and some degree of empirical determination will likely be appropriate, for a given machine and a given toner.

The example is provided for only one specific system, and the potentials P1, P2, P3 P4 applied to the donor roll 122 during each stage of the above method may be those sufficient to perform the recited steps the specific system in which MC-SJD is utilized. The particular combination of voltages and pulse times typically should be selected empirically, based on testing a particular toner in a particular system. For instance, if a system utilizes positively charged toner, the polarities of the applied potentials would be reversed.

In general, the four potentials P1-P4 are with respect to another "offset potential," such as a DC potential, that establishes a bias between the photoreceptor and the donor roll. A typical offset potential which is provided only as an example is about −200 Volts, with respect to the back of the photoreceptor, which is usually grounded. Hence, the terms "positive" and "negative" may or may not be with respect to ground, as defined at the back-surface of the photoreceptor. Note that the "offset potential" could itself be negative, positive, or zero; depending on the mode of operation of the device, and the sign of the charged toner in use.

Figure 4:
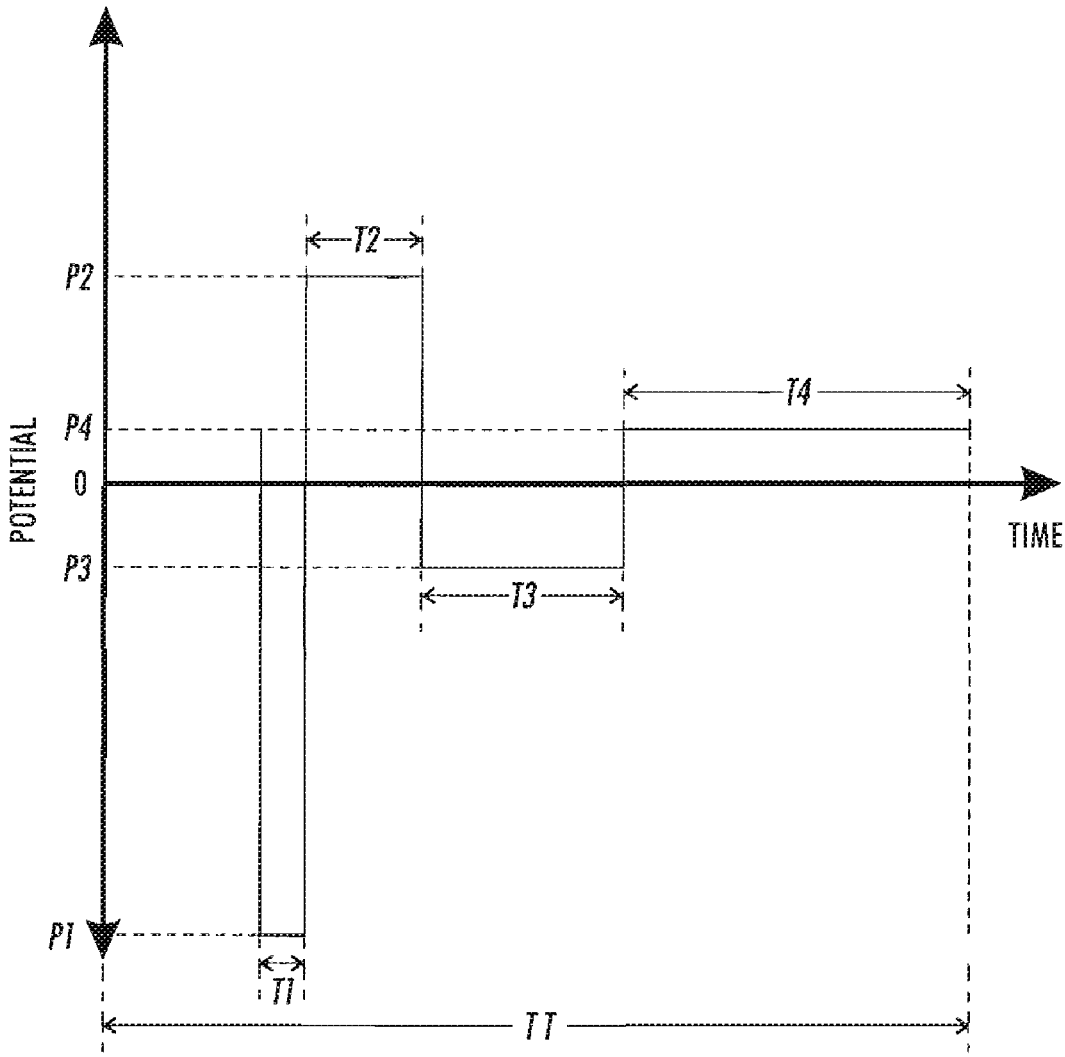
FIG. 4 is an exemplary embodiment of a timing diagram.
Figure 5:
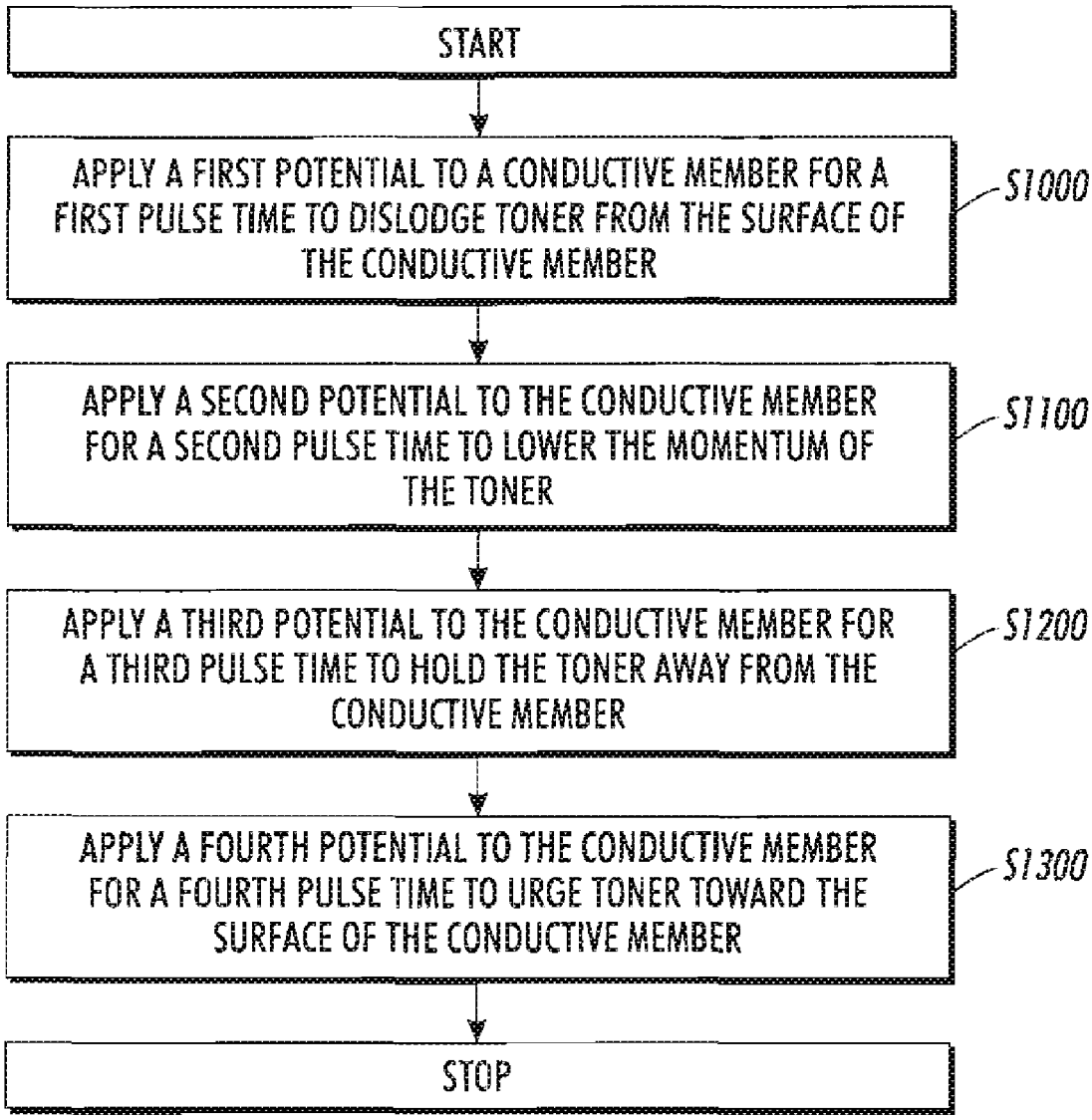
FIG. 5 is a flowchart illustrating an exemplary development method.

FIG. 5 illustrates an exemplary method for dislodging toner from the surface of a conductive member, such as may be utilized to operate a marking device 104 using the MC-SJD process. In step S1000, a first potential is applied to the conductive member for a first pulse time to dislodge toner from the surface of the conductive member. The conductive member may be a donor roll, such as donor roll 122 described above, and the first potential may dislodge the toner from the surface of the donor roll and project the toner into a "developer nip" and toward a photoreceptor. In step S1100, a second potential is applied to the conductive member for a second pulse time to lower the momentum of the toner. In step S1200, a third potential is applied to the conductive member for a third pulse time to hold the toner away from the conductive member. The third potential may hold the toner in a development nip to allow development of a photoreceptor. In step S1300, a fourth potential is applied to the conductive member for a fourth pulse time to urge toner toward the surface of the conductive member. The fourth potential may urge undeveloped toner in a development nip toward the surface of the donor roll. The method may be utilized to modulate the potential applied across the development nip of the above-described marking device 104. The first, second, third and fourth potentials may, for example, correspond respectively to P1-P4 of FIG. 4, and the first, second, third and fourth pulse times may, for example, correspond respectively to T1-T4 of FIG. 4. The polarities of the potentials shown in FIG. 4 may be reversed.

In embodiments, the MC-SJD process provides a first potential P1 applied for a relatively short period of time T1 to strip toner off of the donor's surface and inject it into a development nip. Plastic or other coatings on the donor surface can be used to reduce toner adhesion.

A positive second potential P2 may be applied for a time T2 to slow high-speed toner and prevent the toner from impacting (scavenging) the photoreceptor 110 and any developed toned images on the photoreceptor 110. The applied second potential field should not be so large as to disrupt toner already developed on the latent image of the photoreceptor 110. The applied second potential P2 is applied for a pulse time T2 to provide a "cloud" of near motionless toner hanging in the upper third of a development nip. In this manner, the momentum of the toner cloud is controlled so that energy is not imparted to the surface of the photoreceptor 110 to the detriment of predeveloped images.

The third potential P3 provides for a "drift time" of the third pulse time P3 whereby a near-stationary toner cloud is repelled from regions of the photoreceptor 110 which have "cleaning fields" and attracted to regions with "development fields." A third potential P3 is provided for a third pulse time duration T3 to counter the space-charge effect and hold the toner cloud in place.

A fourth potential P4 provides a bias for the duration T4, which is long enough to sweep unused toner from within a development nip back towards a donor's surface. This resets the process for the next set of pulses P1, P2, P3, P4. The fourth potential P4 should not be strong enough to dislodge toner that has been previously adhered to a photoreceptor in development areas, but should be strong enough to remove undeveloped toner from a development nip 138. This prevents airborne toner in a development nip from otherwise accelerating uncontrolled towards a photoreceptor during the next injection pulse P1. In embodiments, the toner clouds generated utilizing this method are comparable to those that generated by conventional HSD utilizing wires.

Although FIG. 4 indicates "square" pulse shapes for P1 though P4, the actual rise and fall times need not be particularly short. In practice, significant parasitic capacitance may exist between the driven conductive members, so the true waveform may exhibit significant high-frequency cutoff (even to the point where the pulse shapes begin to look somewhat "sinusoidal"). The exact shape of each pulse is not critical to the operation of this invention, as long at the intended function of each of the four pulses can be maintained. By way of example only, the rise and fall times for each pulse (P1-P4) may be on the order of 1/10th of each pulse's respective width (T1-T4).

Figure 6:
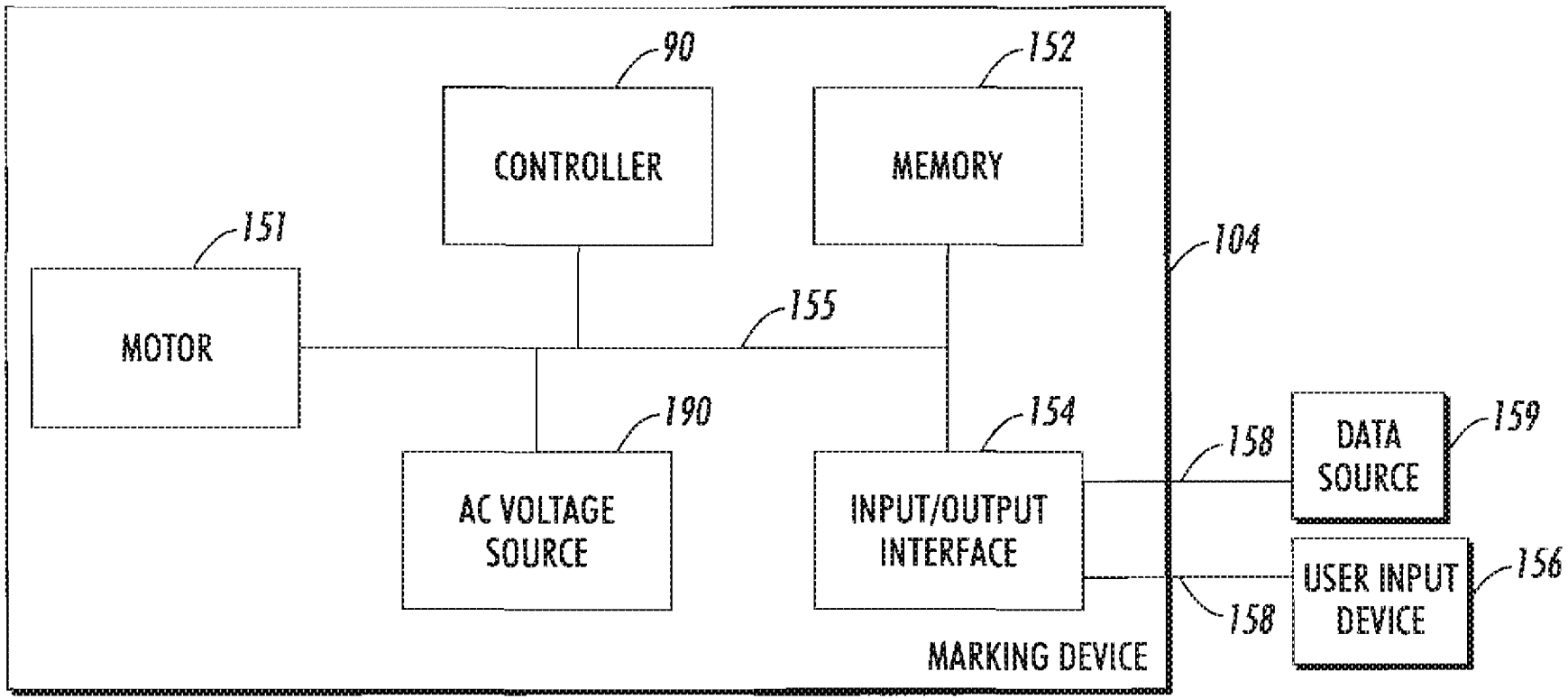
FIG. 6 is a functional block diagram illustrating an exemplary embodiment of a marking device.

FIG. 6 is a functional block diagram illustrating an exemplary embodiment of a marking device 104, which includes a controller 90, memory 152, an input/output interface 154, an AC voltage source 190 and one or more motors 151, which are interconnected by a data/control bus 155. The controller 90 controls the operation of the marking device. For example with reference to FIG. 3, the controller 90 can control operation of a developer unit, including an AC voltage source 190 and one or more motors 151 for the donor roll 122, based in part on signals provided through an input/output interface 154. The controller 90 controls the AC voltage source 190 to provide different voltages at different times, such as described above with reference to FIGS. 4-5.

The system controller 90 communicates with, controls and coordinates interactions between the various systems and subsystems within the machine to implement the operation of the marking device 104. That is, the system controller 90 has a system-wide view and can monitor and adjust the operation of each subsystem affected by changing conditions and changes in other subsystems. Although shown as a single block in FIG. 3, the system controller 90 may comprise a plurality of controllers and/or processing devices and associated memory distributed throughout the printing device employing, for example, a hierarchical process control architecture. The system controller 90 can employ any conventional or commonly used system or technique for controlling a marking device 104.

The input/output interface 154 may convey information from a user input device 156 and/or a data source 159. The controller 90 performs any necessary calculations and executes any necessary programs for implementing the marking device 104, and its individual components and controls the flow of data between other components of the marking device 104 as needed.

The memory 152 may serve as a buffer for information coming into or going out of the marking device 104, may store any necessary programs and/or data for implementing the functions of the marking system 104, and/or may store data at various stages of processing. The memory 152, while depicted as a single entity, may actually be distributed. Alterable portions of the memory 152 are, in various exemplary embodiments, implemented using static or dynamic RAM. However, the memory 152 can also be implemented using a floppy disk and disk drive, a writeable optical disk and disk drive, a hard drive, flash memory or the like. The links 158 may be any suitable wired, wireless or optical links.

The data source 159 can be a digital camera, a scanner, or a locally or remotely located computer, or any other known or later developed device that is capable of generating electronic image data. Similarly, the data source 159 can be any suitable device that stores and/or transmits electronic image data, such as a client or a server of a network. The image data source 159 can be integrated with the marking device 104, as in a digital copier having an integrated scanner. Alternatively, the data source 159 can be connected to the marking device 104 over a connection device, such as a modem, a local area network, a wide area network, an intranet, the Internet, any other distributed processing network, or any other known or later developed connection device.

Figure 7:
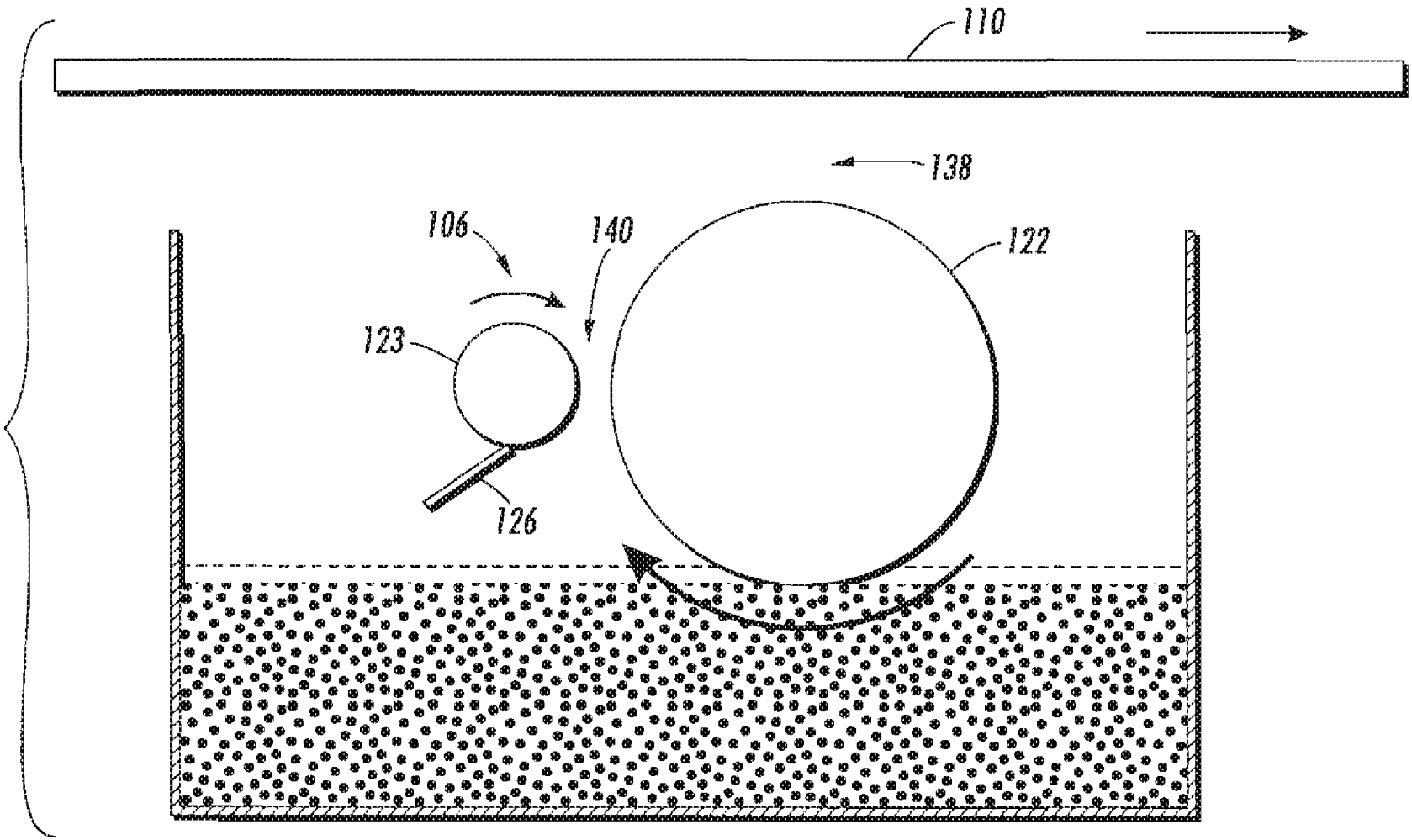
FIG. 7 is a side view of an exemplary embodiment of an apparatus for removing toner from a donor roll.

As shown in FIG. 7, a pre-development station 106 is optionally provided for selectively removing "weakly adhered" toner particles from a donor roll 122. The embodiments of a pre-development station and methods of operating a pre-development station disclosed herein may not be required for the described systems and methods for momentum controlled scavengeless development, but may help achieve better performance. The pre-development station 106 comprises a rotatable conductive receiver 123 in the form of a scavenging roll and a cleaning blade 126. Charged toner resides in the sump and is loaded onto the donor roll 122 as described above. An electric field is applied between the scavenging roll 123 and the donor roll 122 of sufficient amplitude to remove highly charged toner from the donor roll 122, and attract it towards the scavenging roll 123. The scavenging roll 123 rotates downwards. After a portion of the scavenging roll 123 passes through the scavenging nip 140, that portion is cleaned by the cleaning blade 126. Toner removed from the scavenging roll 123 during the cleaning step returns to the sump. The toner remaining on the donor roll 122 now moves on to the development nip 138 region.

An exemplary method is provided for removing toner from a donor roll utilizing a pre-development station. Reference to a pre-development station will be made to elements of FIG. 7, but the method is not limited to being practiced on the embodiment depicted in FIG. 7. This method may be utilized, for example, in the marking device 104 described above. An electric field is applied between a donor roll and a conductive receiver such as the above-described scavenging roll 123, which causes toner to be removed from the donor roll and attracted to the surface of the receiver. A portion of the toner removed from the donor roll during application of the first electric field is transferred onto the surface of the scavenging roll. The conductive receiver may be connected to the same voltage source as is used for applying the above-described voltage waveform to a donor roll. This avoids the necessity of a separate voltage source, and thus reduces cost. However, in some embodiments, a separate voltage source may be desired to better optimize the performance. In embodiments, the one or more voltage sources can apply a voltage to the scavenger roll, alone or in addition to the application of a voltage source to the donor roll. The voltage waveform applied to the scavenger roll may be the same as applied to the donor roll, or different than applied to the donor roll, such as applying to the scavenger roll only portions of voltage waveform applied to the donor roll.

In embodiments, the conductive receiver is cleaned. In embodiments, the cleaning step comprises scraping the scavenging roll with a cleaning blade, such as the cleaning blade 126 described above.

The distance between the donor roll and the receiver may be adjusted to vary the amount of toner removed from the donor roll. Additionally or alternatively, the strength of the first electric field may be adjusted to vary the amount of toner removed from the donor roll. These adjustments may be made by the manufacturer during manufacture of the device, or a suitable adjustment device and/or control input device that may be provided to enable a user or a technician to make the adjustment based on performance.

The strength of the electrical field and the gap distance between the scavenging roll and the donor roll may be chosen so that an "average" toner particle, i.e., one with median triboelectrical attraction just approaches the scavenging roll does not adhere to the donor roll. Toner particles having higher triboelectrical attraction hit the scavenging roll and adhere to its surface. The largest particles, even those with moderate triboelectrical attraction, will have sufficient momentum to collide with and adhere to the surface of the scavenging roll.

The method for removing toner illustrated in FIG. 7 removes the portion of toner from the donor roll that would most likely show up as background in the developed image, thereby reducing background noise on the final developed image.

The pre-developing station strips high triboelectrically attracted toner particles from the donor onto the scavenging roll. The resulting "toner cloud" subsequently produced in the development nip is thus controlled to provide scavengeless development of the latent image formed on the photoreceptor when a pre-development station is used in HSD systems. However, the pre-development station concept may be applied to other contexts as well, including conventional jumping development systems and momentum controlled scavengeless jumping development systems.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for modulating the potential applied across a development nip in a development system having a conductive donor roll and a conductive photoreceptor, the method comprising:

applying a first potential to the donor roll for a first pulse time, wherein the first potential dislodges toner from the surface of a donor roll and projects the toner into a development nip toward a photoreceptor, and applying a second potential to the donor roll for a second pulse time, wherein the second potential lowers the momentum of the toner;

applying a third potential to the donor roll for a third pulse time, wherein the third potential holds the toner in the development nip to allow development of the photoreceptor, wherein the magnitude of the third potential is smaller than the first potential; and applying a fourth potential to the donor roll for a fourth pulse time, wherein the fourth potential urges undeveloped toner in the development nip toward the surface of the donor roll.

2. A method as described in claim 1, wherein the first potential and the third potential are negative; and the second potential and the fourth potential are positive.

3. A method as described in claim 1, wherein the first potential and the third potential are positive; and the second potential and the fourth potential are negative.

4. A method as described in claim 1, wherein the first, second, third, and fourth potentials are different; and the first, second, third, and fourth pulse times are different.

5. A method as described in claim 1, wherein the first pulse time is different from at least one of the second, third, or fourth potential.

6. A method as described in claim 1, wherein the total time period for the first pulse time, the second pulse time, the third pulse time and the fourth pulse time is in the range of from about 150 microseconds to about 600 microseconds.

7. A machine-readable medium on which is stored instructions that, when executed by a controller, cause the controller to perform the method of claim 1.

8. An apparatus for developing a photoreceptor having a latent charge image, comprising:

a rotatable conductive donor roll spaced from the photoreceptor, a voltage source connected to the donor roll, and a controller that applies a first potential to the donor roll for a first pulse time to project toner from the donor roll toward the photoreceptor; applies a second potential to the donor roll for a second pulse time to slow the speed at which the toner is projected toward the photoreceptor; applies a third potential to the donor roll for a third pulse time to hold toner between the donor roll and the photoreceptor, wherein the magnitude of the third potential is smaller than the first potential; and applies a fourth potential to the donor roll for a fourth pulse time to urge undeveloped toner to the surface of the donor roll.

9. An apparatus for developing a photoreceptor as described in claim 8, wherein the first potential and the third potential are negative; and the second potential and the fourth potential are positive.

10. An apparatus for developing a photoreceptor as described in claim 8, wherein the first potential and the third potential are positive; and the second potential and the fourth potential are negative.

11. An apparatus for developing a photoreceptor as described in claim 8, wherein the first, second, third, and fourth potentials are different; and the first, second, third, and fourth pulse times are different.

12. An apparatus for developing a photoreceptor as described in claim 8, wherein the first pulse time is different from at least one of the second, third, or fourth potential.

13. An apparatus for developing a photoreceptor as described in claim 8, wherein the total time period for the first pulse time, the second pulse time, the third pulse time and the fourth pulse time is in the range of from about 150 microseconds to about 600 microseconds.

14. An electrophotographic marking device incorporating the apparatus for developing a photoreceptor as described in claim 8.

15. An apparatus as described in claim 8, further comprising:

a conductive receiver spaced from the donor roll;

a rotatable conductive donor roll spaced from the receiver; and a controller that applies an electric field between the donor roll and the receiver, the electric field causing toner to be removed from a surface of the donor roll and attracted to a surface of the receiver.

16. An apparatus as described in claim 15, wherein the conductive receiver is a rotatable scavenger roll.

17. An apparatus as described in claim 16, further comprising a cleaning blade that scrapes the surface of the scavenger roll to remove toner therefrom.

18. An electrostatic marking device incorporating the apparatus of claim 15.

* * * * *